US011306484B2

(12) United States Patent
Walter

(10) Patent No.: US 11,306,484 B2
(45) Date of Patent: Apr. 19, 2022

(54) APPARATUS AND METHOD FOR WALL DECORATING

(71) Applicant: Gregory Walter, Shorewood, IL (US)

(72) Inventor: Gregory Walter, Shorewood, IL (US)

( * ) Notice: Subject to any disclaimer, the term of this patent is extended or adjusted under 35 U.S.C. 154(b) by 0 days.

(21) Appl. No.: 16/829,790

(22) Filed: Mar. 25, 2020

(65) Prior Publication Data

US 2021/0164233 A1 Jun. 3, 2021

Related U.S. Application Data

(60) Provisional application No. 62/827,024, filed on Mar. 30, 2019.

(51) Int. Cl.
*E04F 13/04* (2006.01)

(52) U.S. Cl.
CPC ..... *E04F 13/045* (2013.01)

(58) Field of Classification Search
CPC ..... E04F 13/02; E04F 13/047; E04F 13/045
See application file for complete search history.

(56) References Cited

U.S. PATENT DOCUMENTS 1,888,234 A * 11/1932 Miller ..... E04F 13/147 264/33
2,313,325 A * 3/1943 Dalton ..... E04F 13/045 52/346
2,810,180 A * 10/1957 Barnack ..... E04F 13/147 249/141
3,687,771 A * 8/1972 Meijer ..... B28B 11/04 156/232
4,917,933 A * 4/1990 Schluter ..... E04B 1/762 428/99
7,622,155 B1 * 11/2009 Pace ..... B44C 1/24 427/356
9,487,951 B2 * 11/2016 Shaw ..... E04F 13/02
2004/0074184 A1 * 4/2004 Naji ..... E04F 13/047 52/344
2013/0287392 A1 * 10/2013 Heimbuch ..... H04B 10/40 398/38

* cited by examiner

*Primary Examiner* — Patrick J Maestri
(74) *Attorney, Agent, or Firm* — Donald G. Flaynik

(57) ABSTRACT

An apparatus and method for securing a deformable material to a wall structure such that the deformable material is allowed to solidify to form a predetermined configuration upon the wall structure, includes securing a fabric member to a wall structure, the fabric member having a configuration that supports a deformable material that ultimately solidifies; a plurality of offset strips (when required) that separate the fabric member from the wall structure to provide an air gap; and fasteners that maintain the relative position of the fabric upon the wall structure throughout the application of the deformable material upon the fabric member, the configuring of a design into the deformable material, and after the deformable material has solidified.

20 Claims, 8 Drawing Sheets

APPARATUS AND METHOD FOR WALL DECORATING

This Utility Patent Application is based on Provisional Patent Application No. 62/827,024 filed on Mar. 30, 2019.

BACKGROUND OF THE INVENTION

1. Field of the Invention

The present invention relates to an apparatus and method for wall decorating by impressing a design in deformable material secured to a wall. The deformable material includes but is not limited to concrete, grout, mortar, plaster, cultured stone and veneer stone that is secured to a vertical structure inside a building, or an outside wall exposed to natural elements. The present invention includes a relatively light weight flexible fabric or board section secured to the vertical structure such that an inner side of the flexible fabric or board engages the vertical structure; and an outer side of the flexible fabric or board is configured to receive and secure the deformable material to the outer side, thereby allowing a design to be impressed into the deformable material, resulting in a permanent design upon the vertical structure after the deformable material solidifies.

2. Background of the Prior Art

Typically, a plurality of laths fabricated from wood or metal are disposed horizontally parallel on a vertical or wall structure to provide a base upon which a deformable material can be disposed and secured to the vertical structure. The secured deformable material is ultimately configured via a stamp or similar device impressing a preselected design into the deformable material. In order to maintain the position of the deformable material upon the wall structure, a plurality of laths have to be disposed parallel and in close proximity to adjacent laths upon the wall structure whereby a gap of approximately one-inch separates adjacent laths, thereby enabling a relatively viscous deformable material to adhere to the laths. This close proximate relationship between the laths results in a relatively time consuming and expensive project when a relatively large vertical structure is to be covered with the deformable material.

Beside the time and costs of using laths for a vertical structure, another problem arises when the deformable material that engages the laths has a relatively "liquid" parameter that causes the deformable material to "run" or otherwise flow upon the laths rather than maintaining a selected position.

More specifically, metal, wood or fiberglass laths need to be screwed or nailed individually into a vertical wall or similar support structure, whereby sufficient space is provided adjacent laths that allow a predetermined quantity of mortar, plaster or similar material to be applied to the support structure. The quantity of applied mortar must enable a preselected design to be raked, profiled, scratch-coated or otherwise impressed into the mortar when in a deformable condition. However, because a space is present between adjacent laths, if the individual applying a deformable material to the laths is not consistent with the manual pressure impressed upon the deformable material being applied to the laths, the material can be "wasted" by being pressed through the space and falling from the laths on the opposite side due to an excessive manual force. Further, if an insufficient quantity of manual force is impressed upon the deformable material when applied to the laths, the applied deformable material can fall from the laths causing the individual to apply a new portion of material.

A need exits for an apparatus and method that inexpensively and quickly provides a foundation or base upon a vertical structure to receive and maintain the position of deformable material when disposed upon the base, when a design is impressed upon the deformable material, and though the solidifying process of the deformable material.

SUMMARY OF THE INVENTION

It is an object of the present invention to overcome many of the disadvantages associated with prior art devices and methods for applying deformable material such as mortar or similar cementitious material onto a wall or ceiling surface, then impressing a design into the deformable material, whereupon, the deformable material hardens and the impressed design becomes a permanent configuration in the hardened deformable material. A principal object of the present invention is to provide a device and method for receiving a cementitious material that will be configured with a preselected design. A feature of the device and method is a relatively light weight flexible fabric member or substantially rigid board sections that cover the entire surface of a structure selected to display a predetermined design. An advantage of the device and method is that the light weight fabric member or rigid board section, or a combination of both fabric member and board section can be quickly secured to the surface of a selected structure, thereby saving time and costs to provide a deformable material receiving fabric member capable of supporting a deformable material when a design is forcibly impressed into the deformable material, whereupon, the design is maintained throughout the hardening process of the deformable material.

Another object of the present invention is to provide a surface configuration for an outer wall of the fabric member that promotes the securing of the deformable material upon the outer wall of the fabric member when the fabric member is orientated vertically upon a wall structure. A feature of the surface configuration of the fabric member is that the configuration corresponds to the viscosity of the deformable material. An advantage of the surface configuration corresponding to viscosity is that the less viscous (more liquid) the deformable material, the smaller the acute angle of aperture walls that engage and support the deformable material disposed upon the receiving member.

Still another object of the present invention is to secure the fabric member to a structure with fastener members that do not obstruct the impressing of a design into the deformable material. A feature of the device and method is that the fastening members are disposed in the recesses that receive and support the deformable material. An advantage of the device and method is that the recessed fastening members prevent engagement between a tool that impresses a design into the deformable material and one or more of the fastening members.

Yet another object of the present invention is to provide an air gap between the deformable material receiving member and a wall structure. A feature of the device and method is offset strips vertically secured to the wall structure, whereby the offset strips are horizontally separated a predetermined distance. Another feature of the device and method is that the offset strips are dimensioned to separate the fabric member from the wall structure a predetermined distance after the fabric member is attached to the offset strips. An advantage of the offset strips separation and dimensions is that an air gap is formed that prevents moisture from being trapped between the receiving member and the wall structure, resulting in the prevention of mold or decay of the fabric member and/or the wall structure.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
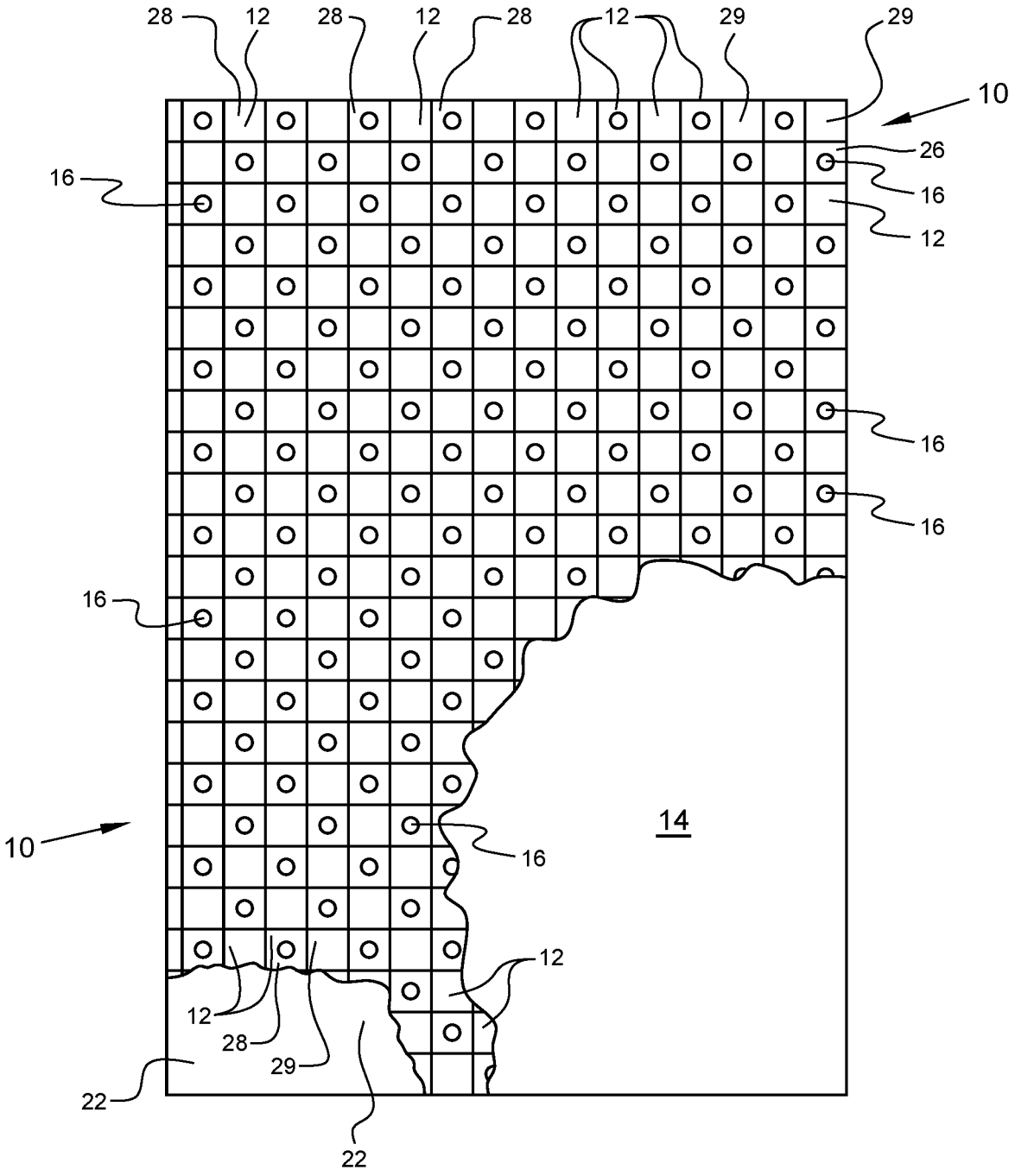
FIG. 1 is a front elevation view of an apparatus for decorating a deformable material secured to a wall structure in accordance with the present invention.
Figure 2:
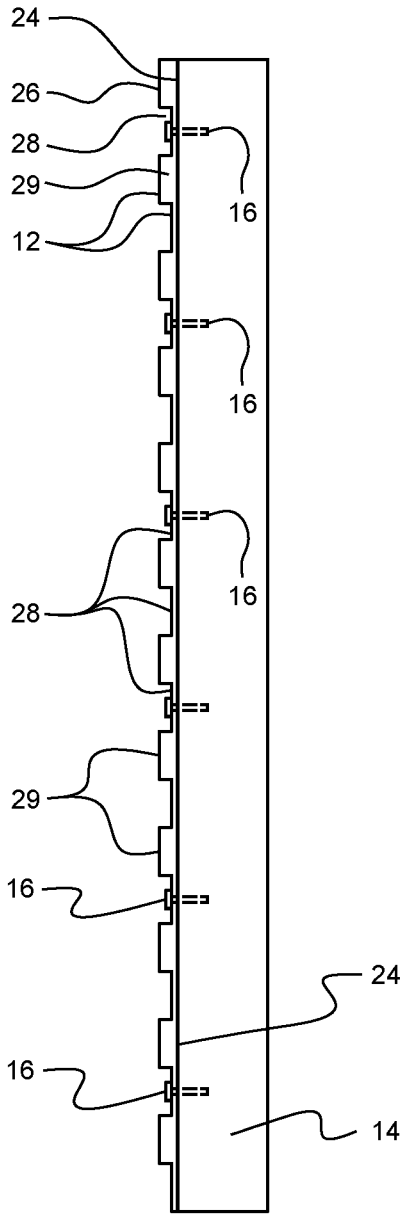
FIG. 2 is a right-side elevation view of FIG. 1, but with a fabric member completely vertically depicted, and without lower portion covered by a deformable material.
Figure 3:
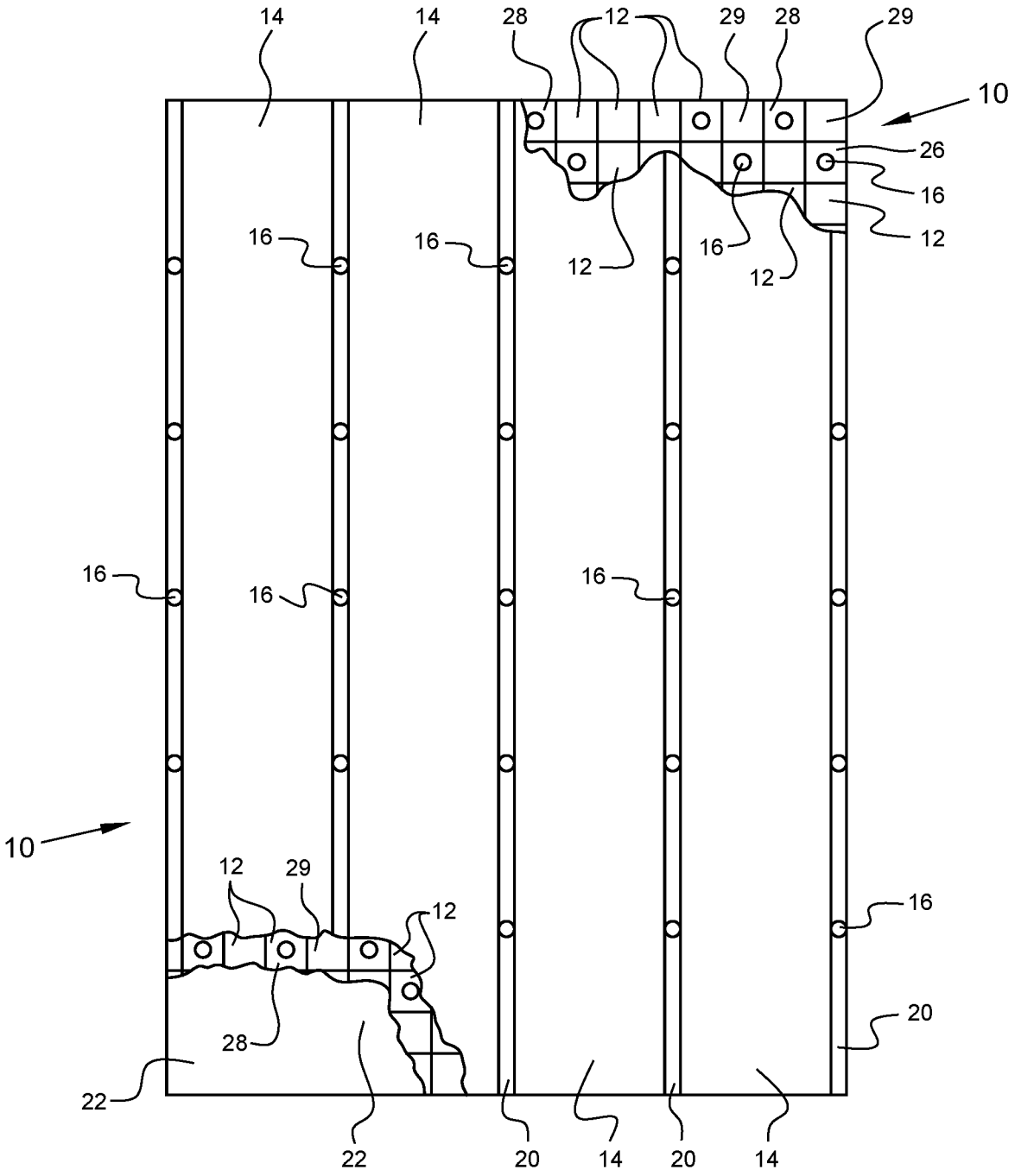
FIG. 3 is the front elevation view 1, but with off-set strips depicted to separate flexible fabric from a wall structure.
Figure 4:
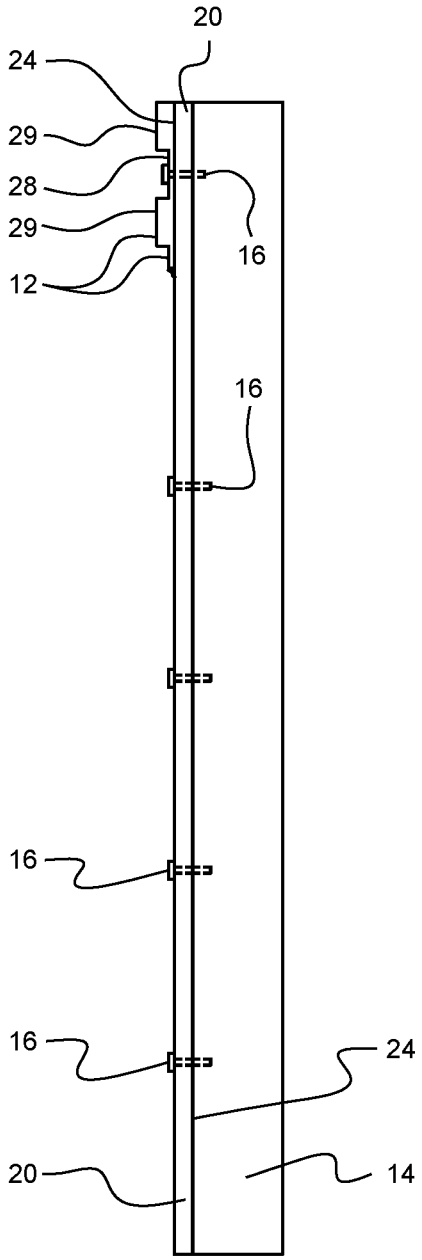
FIG. 4 is a right-side edge elevation view of FIG. 3, but without a lower portion covered by a fabric member and deformable material.
Figure 5:
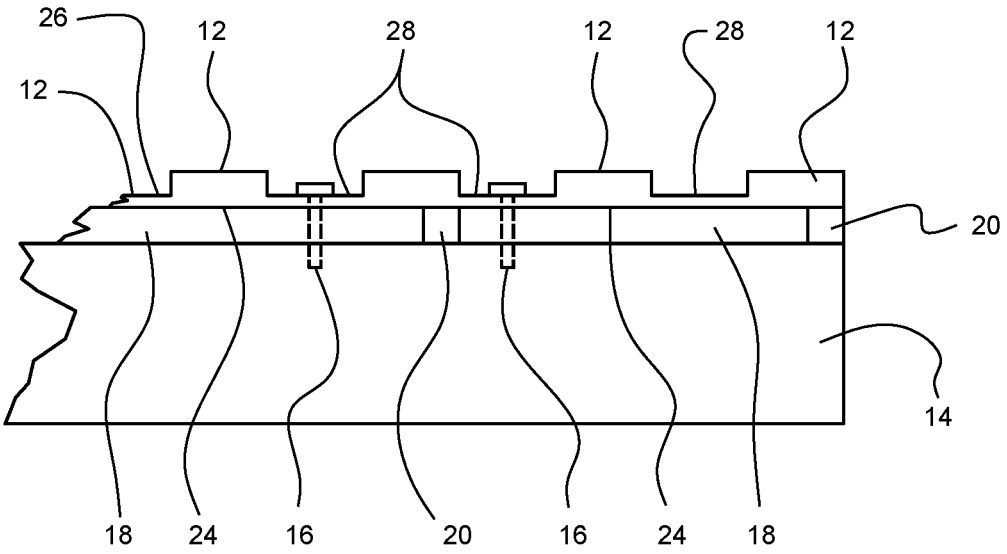
FIG. 5 is a bottom elevation view of a right-side portion of FIG. 1.
Figure 6:
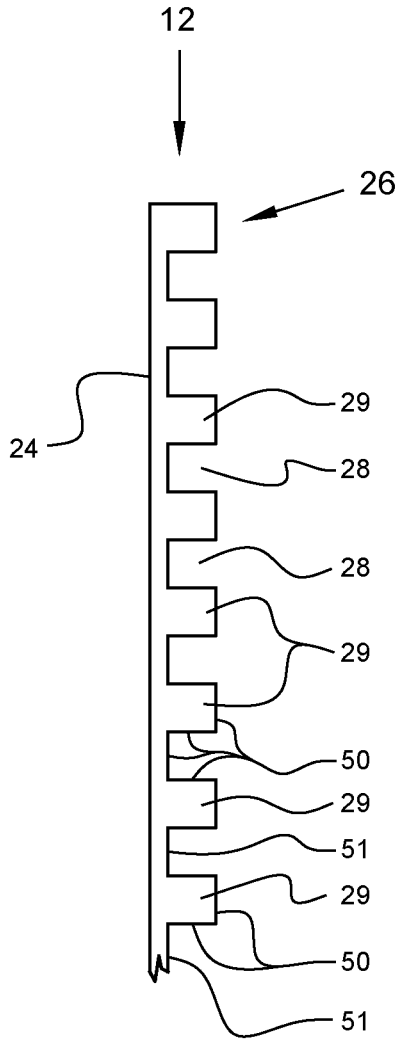
FIG. 6 is a side elevation view of the flexible fabric of FIG. 1 depicting a substantially square configuration

Referring to FIGS. 1-6, an apparatus for decorating a deformable material secured to indoor or outdoor wall structures in accordance with the present invention is denoted as numeral 10. The apparatus 10 includes a relatively flexible fabric member secured to a wall structure 14. An alternative to the fabric member 12 is a plurality of "bendable" yet relatively rigid panel boards (not depicted) having the same configurations (see FIGS. 1 and 2) as the fabric member 12. The flexible fabric member 12 is preferred and includes an inner side 24 that engages the surface of the wall structure 14. The fabric member 12 is secured to the wall structure 14 via multiple fasteners 16. When an air gap 18 is required between the fabric member 12 and the wall structure 14 to prevent moisture and/or condensation from becoming trapped between the fabric member 12 and the wall structure 14; offset strips 20 for spacing the fabric member 12 from the wall structure 14 a predetermined distance are secured via multiple fasteners 16 to the surface of the wall structure 14. The fabric member 12 is then disposed upon and secured to the offset strips 20. The fabric member 12 includes an outer side 26 having a configuration that supports a predetermined quantity of deformable material 22 such as concrete, grout, mortar, plaster, cultured stone and veneer stone that ultimately solidifies upon the fabric member 12. The location of the wall structure 14 selected for decorating determines the material of fabrication for both the fabric member 12 and the deformable material 22. Wall structures inside buildings allow all of the specified materials for both the fabric member 12 and the deformable material 22 to be used. Wall structures 22 exposed to outside weather conditions require the material for fabrication for the fabric member 12 and the deformable material 22 to be consistent with the materials specified for outdoor construction for the weather conditions encountered for the geographical area the wall structure 22 to be decorated is located.

The fasteners 16 that secure and maintain the relative position of the fabric 12 member upon the wall structure 14 when the predetermined quantity of deformable material 22 is disposed upon the flexible fabric 12 are well known to those of ordinary skill in the art and include, but are not limited to screws, nails, glue, bolts and combinations thereof that are fabricated from stainless steel, copper, polymers, and similar materials that provide for indoor and outdoor usage. The deformable material 22 disposed upon the fabric member 12 ultimately completely covers all portions of the fabric 12, which covers all preselected portions of the wall structure 14. The fasteners 16 continue to maintain the relative position of the fabric member 12 and the deformable material 22 disposed upon the fabric member 12 when a preselected stamp (not depicted) is forcibly urged into the deformable material 22.

The stamp ultimately forms a predetermined configuration or design in the deformable material 22; whereupon, the stamp is removed from the deformable material 22 and the deformable material 22 ultimately solidifies to form a permanent configuration or design in the deformable material 22. The deformable material 22 and the design thereon appear to be integrally joined to the wall structure 14 by an observer irrespective of the observer's direction of view of the wall structure 14 due to the flexible fabric member 12 totally covering the wall structure 14 and the deformable material 22 totally covering the fabric member 12, whereby, the fabric member 12 supporting the deformable material 22 cannot be seen by the observer before or after the material 22 hardens.

The flexible fabric 12 can be fabricated from a myriad of relatively strong materials having substantial tensile strength including but not limited to cotton, synthetic resin and fiber materials, fiberglass, basalt, calcium silicate hydrate, polymers including rigid polymer foam (polyurethane), light weight concrete, and combinations thereof. The flexible fabric 12 can be heat formed or extruded into flexible rolls or rigid sections or panels having predetermined configurations. The flexible fabric 12 can be a textile resin material lightly coated with an epoxy or a urethane acrylic compound on an inner side 24 that ultimately engages a cooperating surface of the wall structure 14. The slightly wet resin of the outer side 26 of the fabric member 12 receives a "broadcast" coating of silica sand (not depicted). The silica sand attaches to or "sticks" on the outer side 26, resulting in the reduction of flexibility of the fabric member 12 to maintain a predetermined configuration for the outer side 26 of the fabric 12 that promotes the securing of the deformable material 22 to the outer side 26 of the flexible fabric 12. The silica sand on the outer side 26 of the fabric member 12 enables the outer side 26 side to chemically react with the cement compounds in the deformable material 22 to form chemical bonds between the flexible fabric 12 and the deformable material 22, resulting in the binding of the deformable material 22 to the flexible fabric 12.

The fabric member 12 is light weight and can be shipped in rolls or stacked sheets for reducing the cost of shipping and handling of the fabric 12. Further, rolls of the fabric member improves safety and reduces time when cutting the fabric 12 to cover portions or the entire surface of the wall structure 14. The fabric member 12 is ready to receive the deformable material 22 after the fabric member 12 is secured to the wall structure 14; resulting in the reduction of time and money to secure the deformable material 22 to the wall structure 14, when compared to the time and cost to secure laths or similar prior art members that support deformable material 22.

The offset strips 20 for forming an air gap 18 between the flexible fabric 12 and the wall structure 14 are dimensioned to include a lateral dimension, when taking a front elevation view (see FIG. 3) of the wall structure 14, between one-quarter and one inch; and a lateral dimension, when taking a side elevation view (see FIG. 4) of the wall structure 14, between one-quarter and one inch. The offset strips 20 can be secured to the wall structure 14 via the same fasteners used to secure the flexible fabric 12 to the wall structure 14. The offset strips can be arranged on the wall structure 14 vertically, horizontally, diagonally, in a "checkerboard" configuration and combinations thereof. The offset strips 20 can be integrally formed to the inner sidewall 24 of rigid panels 12, the offset strips 20 being secured to the wall structure 14 and the outer side wall 26 of the rigid panels 12 ultimately receiving the deformable material 22. Irrespective of the dimensions and the material of fabrication for the offset strips 20, the offset strips 20 must be orientated substantially vertical to allow water to drain out weep holes (not depicted) disposed at the bottom of the deformable material 22.

The offset strips 20 can be fabricated from the relatively rigid materials discussed above (including fiberglass, calcium silicate hydrate and polymers) configured in rolls or relatively thin sheets, or can be fabricated from different materials such as wood or metal having structural strength capable of supporting the fabric 12 and the attached deformable material 22. The flexible fabric 12 is ultimately joined to the offset strips 20 (via the fasteners 16 discussed above) after the strips 20 are secured to the wall structure 14. The air gap 18 prevents moisture and/or condensation from becoming trapped between the flexible fabric 12 and the wall structure 14. The trapped condensation can result in a mold health problem, and/or the decay of the offset strips 20. Further, the offset strips 20 enable a user of the apparatus to better "stretch" the flexible fabric 12 when securing the fabric 12 upon the offset strips 20 to the fabric or rigid board 12 after being secured to the wall structure 14.

The outer side 26 of the fabric or relatively rigid board 12 includes a resin, silane or broadcast silica treatment that bonds to cementitious materials. The selected resin includes hydroxyl bonding capabilities that forms chemical bonds, including but not limited to alkoxy silane forming silicon-oxygen binds. For example, silica sand can be broadcast on the surface of epoxy resin that is integral to the fabric or flexible board 12, resulting in aa rougher profile and the forming of silicates (i.e. ettringite, calcium silicate hydrate) that ultimately bond with a cementitious material.

Referring to side elevation FIGS. 6-11, three dimensional configurations are depicted that promote sufficient rigidity to enable the fabric member 12 to receive and retain the deformable material 22 disposed on the fabric member 12. The configurations used to support and secure the deformable material 22 to a wall structure 14 corresponds to the type and viscosity of the deformable material 22. For example, referring to the side elevation view of FIG. 6, the fabric member 12 depicts a substantially square configuration with deformable material 22 receiving recesses 28 formed by substantially square configured protrusions 29. The dimension of each side 50 of the square configured recesses and protrusions 28 and 29, is about one-eighth of an inch, and the depth of the deformable material 22 disposed upon the fabric member 12 is about one-quarter of an inch from an inner side 51 of the recesses 28 to the surface of the deformable material 22 (not depicted). The square configuration of FIG. 6 would be selected when a solid such as veneer stone combined with a relatively high viscosity ("thick"), concrete material was the selected deformable material 22 being disposed upon the fabric member 12. The relatively small dimensions for the sides 50 and the concrete material depth is to limit the weight of the deformable material being disposed upon the structure 14, thereby avoiding added expenditures to reinforce the wall structure 14.

Figure 7:
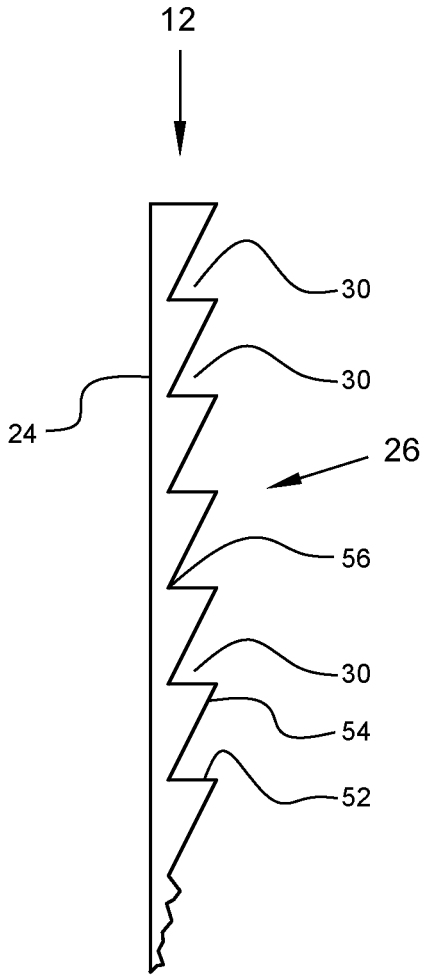
FIG. 7 is a side elevation view of a flexible fabric depicting a substantially triangular configuration.

Referring to the side elevation view of FIG. 7, the fabric member 12 depicts a substantially triangular configuration for supporting and securing deformable material 22 to the fabric member 12. The fabric member 12 includes receiving recesses 30 having a horizontal side 52 and an angled side 54. The fabric member 12 of FIG. 7 would be selected when a relatively high viscosity, concrete material was the selected deformable material 22 being disposed upon the fabric members 12. The dimension of the horizontal side 52 is about one-eighth of an inch, the angle side 54 dimension is about three-eighth of an inch, and the depth of the deformable material 22 disposed upon the fabric member 12 is about one-quarter of an inch from the joining point 56 of the two sides 54 and 56 to the surface of the deformable material 22.

Figure 8:
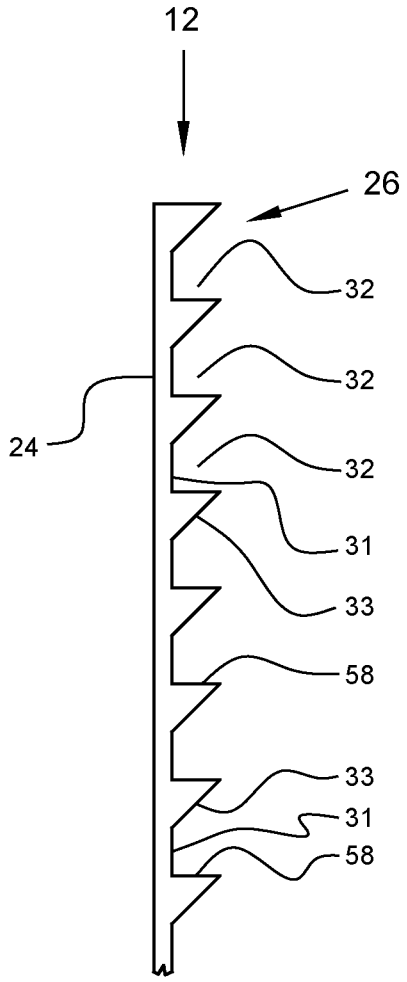
FIG. 8 is a side elevation view of a flexible fabric depicting a substantially square-triangular combination configuration.

Referring to the side elevation view of FIG. 8, the fabric member 12 depicts a receiving recess 32 having a substantially square portion with horizontal and vertical sides 58 and 31, and an angled side 33. The fabric member 12 of FIG. 8 would be selected when a mortar material was the selected deformable material 22 being disposed upon the fabric members 12. The dimension of the horizontal and vertical sides 58 and 31 is about one-eighth of an inch, the angled side 33 dimension is about three-eighth of an inch, and the depth of the deformable material 22 disposed upon the fabric member 12 is about one-quarter of an inch from the vertical side 31 to the surface of the deformable material.

Figure 9:
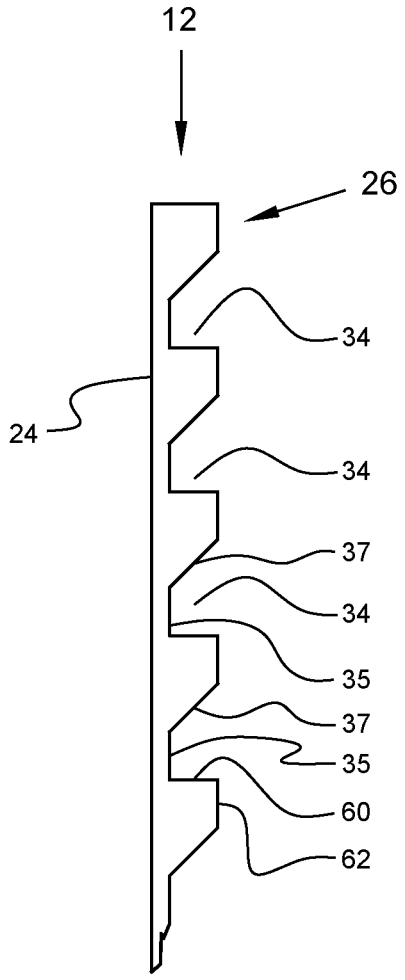
FIG. 9 is a side elevation view of a flexible fabric depicting a substantially square-angular combination configuration.

Referring to the side elevation view of FIG. 9, the fabric member 12 depicts a receiving recess 34 having a substantially square portion with horizontal and inner vertical sides 60 and 35, an angled side 37, and an outer vertical side 62. The fabric member 12 of FIG. 9 would be selected when a relatively low viscosity ("thin"), plaster material was the selected deformable material 22 being disposed upon the fabric members 12. The dimension of the horizontal and inner vertical sides 60 and 35, and the outer vertical side 62 is about one-eighth of an inch; the angled side 37 dimension is about three-eighth of an inch, and the depth of the deformable material 22 disposed upon the fabric member 12 is about one-quarter of an inch from the inner vertical side 35 to the surface of the deformable material.

Figure 10:
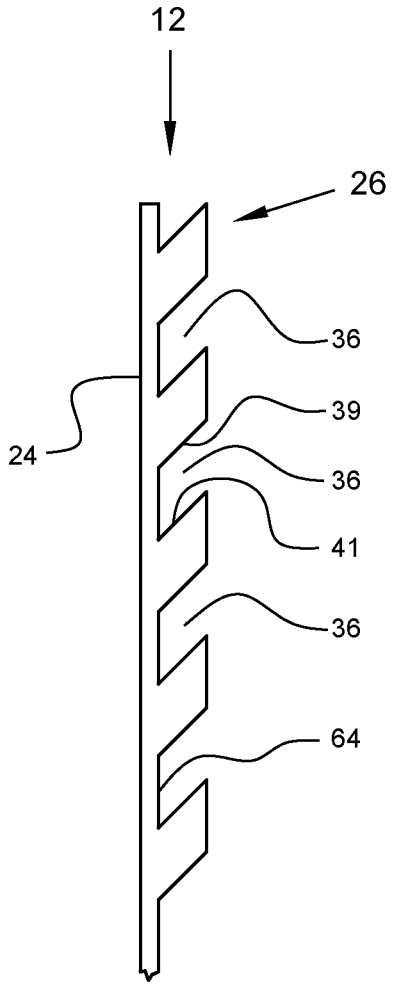
FIG. 10 is a side elevation view of a flexible fabric depicting a substantially parallel-angular combination configuration.

Referring to the side elevation view of FIG. 10, the fabric member 12 depicts a receiving recess 36 having upper and lower angled parallel sides 39 and 41, and a vertical side 64. The fabric member 12 of FIG. 10 would be selected when a relatively low viscosity, grout was the selected deformable material 22 being disposed upon the fabric members 12. The dimension of the parallel sides 39 and 41, and the vertical side 64 is about one-eighth of an inch, and the depth of the deformable material 22 disposed upon the fabric member 12 is about one-quarter of an inch from the vertical side 64 to the surface of the deformable material.

Figure 11:
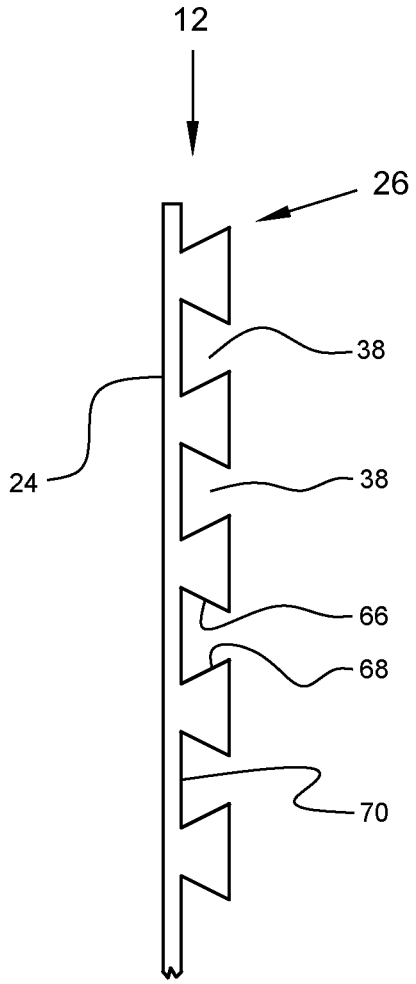
FIG. 11 is a side elevation view of a flexible fabric depicting a substantially "dovetail" configuration.

Referring to the side elevation view of FIG. 11, the fabric member 12 depicts a receiving recess 38 having upper and lower opposite angled sides 66 and 68, and a vertical side 70 that form a "dovetail" configuration. The fabric member 12 of FIG. 11 would be selected when a relatively low viscosity, grout was the selected deformable material 22 being disposed upon the fabric members 12. The dimension of the opposite angled sides 66 and 68, and the vertical side 70 is about one-eighth of an inch, and the depth of the deformable material 22 disposed upon the fabric member 12 is about one-quarter of an inch from the vertical side 70 to the surface of the deformable material.

In operation, a method for decorating a deformable material 22 secured to a wall structure 14 such that a design can be impressed into the deformable material 22, then allowed to solidify, Includes the step of selecting a deformable material 22 capable of withstanding or otherwise cooperating with the ambient elements ("inside or outside") of the location of the wall structure to be decorated. After selecting the type of deformable material 22 (concrete, plaster, mortar, grout, etc.) and the viscosity for the selected type of deformable material 22, a fabric member 12 is selected having a configuration that cooperates with the viscosity of the deformable material 22 to be disposed upon the wall structure 14. The fabric member 12 is then secured to the wall structure 14 via fasteners well known to those of ordinary skill in the art.

If the presence of moisture is possible, an air gap 18 is required between the flexible fabric 12 and the wall structure 14. If an air gap 18 is required, the method includes the added step of securing multiple offset strips 20 to the wall structure 14; then securing the fabric member 12 to the offset strips 20 or in the alternative, securing a flexible fabric 12 having offset strips integrally joined to an inner wall of the fabric member 12 to the wall structure 14. Irrespective of the fabric member 12-offset strip 20 combination, fasteners 16 are selected to secure the relative positions of the fabric member 12 and the offset strips 20 upon the wall structure 14 when a predetermined deformable material 22 is applied to the fabric member 12. After securing the fabric member 12 to the wall structure 14, a preselected stamp or similar design tool is impressed into the deformable material 22 after the deformable material 22 has sufficiently hardened to accept the stamp without deforming the deformable material 22; whereupon, the stamp is removed from the deformable material 22 before the deformable material has solidified, resulting in a permanent design impressed into the deformable material 22.

The foregoing description is for the purpose of illustration only and is not intended to limit the scope of protection accorded this invention. The scope of protection is to be measured by the following claims, which should be interpreted as broadly as the inventive contribution permits.

The invention claimed is:

1. A method for decorating a wall structure, said method comprising the steps of:

selecting a deformable material for a wall structure, providing a fabric member having a preselected configuration that receives said deformable material, whereby said fabric member configuration supports and secures said deformable material upon the wall structure;

providing offset strips for forming an air gap between said fabric member and the wall structure;

securing said fabric member upon the wall structure;

disposing said deformable material upon said fabric member whereby said disposed deformable material includes a preselected depth;

selecting a stamp for impressing a preselected configuration in said deformable material;

allowing said deformable material to sufficiently harden for removably receiving said stamp for impressing a design into said sufficiently hardened deformable material;

placing said stamp on a portion of the deformable material; and stamping the deformable material with said stamp; whereupon, said stamp is removed from said deformable material before said deformable material solidifies, whereby the impressed design is maintained in said deformable material, said stamp being placed on remaining portions of the deformable material and impressed into the remaining portions of said deformable material until the wall structure achieves a predetermined decoration.

2. The method of claim 1 wherein said step of providing a fabric member includes the step of providing a fabric member fabricated from cotton, wool, nylon, rayon and combinations thereof.

3. The method of claim 1 wherein said step of providing offset strips for forming an air gap between said fabric member and the wall structure includes the step of securing a plurality of substantially diagonally aligned offset strips to the wall structure.

4. The method of claim 1 wherein said step of providing a fabric member includes the step of providing a fabric member fabricated from calcium silicate hydrate.

5. The method of claim 1 wherein said step of providing a fabric member includes the step of providing a fabric member fabricated from a polymer material.

6. The method of claim 1 wherein said step of providing a fabric member includes the step of providing a fabric member having a three-dimensional configuration that includes deformable material receiving recesses that support and retain said deformable material when disposed on the fabric member; when a design is impressed into the deformable material; and after said deformable material solidifies.

7. The method of claim 6 wherein said step of providing a fabric member includes the step of providing a fabric member having substantially square configured deformable material receiving recesses.

8. The method of claim 6 wherein said step of providing a fabric member includes the step of providing a fabric member having substantially triangular configured deformable material receiving recesses.

9. The method of claim 6 wherein said step of providing a fabric member includes the step of providing a fabric member having deformable material receiving recesses with substantially a square portion and an angled side.

10. The method of claim 6 wherein said step of providing a fabric member includes the step of providing a fabric member having deformable material receiving recesses with a substantially square portion with horizontal and inner vertical sides, an angled side, and an outer vertical side.

11. The method of claim 6 wherein said step of providing a fabric member includes the step of providing a fabric member having deformable material receiving recesses with upper and lower angled parallel sides, and a vertical side.

12. The method of claim 6 wherein said step of providing a fabric member to a wall structure includes the step of providing a fabric member having deformable material receiving recesses with upper and lower opposite angled sides, and a vertical side 70 that form a dovetail configuration.

13. The method of claim 1 wherein said step of providing offset strips for forming an air gap between said fabric member and the wall structure includes the step of dimensioning said offset strips whereby predetermined air gaps are configured between adjacent offset strips.

14. The method of claim 1 wherein said step of providing offset strips for forming an air gap between said fabric member and the wall structure includes the step of providing a plurality of offset strips integrally joined to said fabric member before said fabric member is secured to a wall structure, thereby separating said fabric member from the wall structure without securing said plurality of offset strips to the wall structure before said fabric member is secured to the wall structure.

15. The method of claim 1 wherein said step of providing offset strips for forming an air gap between said fabric member and the wall structure includes the step of securing a plurality of vertically aligned offset strips to the wall structure.

16. The method of claim 1 wherein said step of providing a fabric member includes the step of providing a fabric member having a three-dimensional configuration that includes deformable material receiving recesses that support and retain a low viscosity deformable material when disposed on the fabric member; when a design is impressed into the deformable material; and after said deformable material solidifies.

17. The method of claim 16 wherein said step of providing a fabric member having a three-dimensional configuration includes the step of selecting a three-dimensional configuration for said fabric member that maintains a high viscosity deformable material upon said fabric member.

18. The method of claim 13 wherein said step of securing said fabric member upon the wall structure includes the step of forcibly inserting fasteners through said fabric member and through said offset strips and into the wall structure, whereby said fasteners maintain the positions of said fabric member and said offset strips upon the wall structure after the predetermined deformable material is disposed upon said fabric member, said fasteners being disposed whereby said fasteners promote the unobstructed impressing of a predetermined design into the deformable material.

19. A method for securing a deformable material to a wall structure, said deformable material ultimately solidifying to form a predetermined configuration upon the wall structure, said method comprising the steps of:

selecting a deformable material for a wall structure;

providing a fabric member having a preselected configuration that receives said deformable material, whereby said fabric member configuration supports and secures said deformable material upon the wall structure;

providing offset strips dimensioned for forming a corresponding air gap between said fabric member and the wall structure;

securing said fabric member upon the wall structure;

disposing said deformable material upon said fabric member whereby said deformable material includes a preselected depth;

selecting a stamp for impressing a preselected configuration in said deformable material;

allowing said deformable material to sufficiently harden for removably receiving said stamp for impressing a design into said sufficiently hardened deformable material;

placing said stamp on a portion of the deformable material; and stamping the deformable material with said stamp; whereupon, said stamp is removed from said deformable material before said deformable material solidifies, whereby the impressed design is maintained in said deformable material, said stamp being placed on remaining portions of the deformable material and impressed into the remaining portions of said deformable material until the wall structure achieves a predetermined decoration.

20. A method for forming a predetermined configuration on a wall structure, said method comprising the steps of:

selecting a deformable material for a wall structure;

providing a fabric member having a preselected configuration that receives said deformable material, whereby said fabric member configuration supports and secures said deformable material upon the wall structure;

providing offset strips integrally joined to said fabric member before said fabric member is secured to the wall structure, said offset strips forming a corresponding air gap between said fabric member and the wall structure;

securing said fabric member upon the wall structure;

disposing said deformable material upon said fabric member whereby said deformable material includes a preselected depth;

selecting a stamp for impressing a preselected configuration in said deformable material;

allowing said deformable material to sufficiently harden for removably receiving said stamp for impressing a predetermined configuration into said sufficiently hardened deformable material;

placing said stamp on a portion of the deformable material; and stamping the deformable material with said stamp; whereupon, said stamp is removed from said deformable material before said deformable material solidifies, whereby the impressed design is maintained in said deformable material, said stamp being placed on remaining portions of the deformable material and impressed into the remaining portions of said deformable material until the wall structure achieves a predetermined decoration.

* * * * *